US005092248A

United States Patent [19]

Parry

[11] Patent Number: 5,092,248

[45] Date of Patent: Mar. 3, 1992

[54] RAILWAY WAGON RETARDER

[75] Inventor: Ian C. Parry, Cheltenham, England

[73] Assignee: Ultra Hydraulics Limited, Cheltenham, England

[21] Appl. No.: 519,106

[22] Filed: May 3, 1990

[30] Foreign Application Priority Data

May 9, 1989 [GB] United Kingdom ..... 8910633

[51] Int. Cl.[5] ..... B61K 7/02

[52] U.S. Cl. ..... 104/26.2; 104/162; 188/62

[58] Field of Search ..... 104/26.2, 162, 256, 104/249, 250; 188/62, 280

[56] References Cited

U.S. PATENT DOCUMENTS

| | | | |
|---|---|---|---|
| 3,040,676 | 6/1962 | Checkley et al. | 104/162 |
| 3,107,633 | 10/1963 | Bick | 104/26.2 |
| 3,148,633 | 9/1964 | Bick et al. | 104/162 |
| 3,373,699 | 3/1968 | Bick et al. | 104/162 |
| 3,637,052 | 1/1972 | Bick | 188/62 |
| 4,198,909 | 4/1980 | Plantureux | 188/62 |
| 4,650,038 | 3/1987 | Bick | 104/26.2 |
| 4,721,189 | 1/1988 | Bick | 104/26.2 |

FOREIGN PATENT DOCUMENTS

| | | | |
|---|---|---|---|
| 3604163 | 8/1987 | Fed. Rep. of Germany | 104/26.2 |
| 1271782 | 11/1986 | U.S.S.R. | 104/26.2 |
| 1462045 | 1/1977 | United Kingdom . | |

*Primary Examiner*—Robert J. Oberleitner
*Assistant Examiner*—Mark T. Le
*Attorney, Agent, or Firm*—Young & Thompson

[57] ABSTRACT

The retarder is installed adjacent a railway track for reducing the speed of a wagon rolling along the track and additionally has the capability of boosting the speed of a wagon. The retarder includes a hydraulic unit having a portion adapted to be deflected out of the path of a wheel of the wagon when directly or indirectly engaged by the wheel before returning to its original position. The unit has adjustable hydraulic damping capable of resisting such deflection to retard the wagon, and a wagon speed responder for adjusting the hydraulic damping of the unit to retard a wagon travelling at high speed. The retarder further includes a regenerative source of hydraulic fluid under pressure connected to the unit by a selector valve such that, when a wagon passes over the unit travelling at high speed, the resultant retarding operation of the unit results in charging of the regenerative source with hydraulic fluid, whereas, when a wagon subsequently passes over the unit travelling at low speed, hydraulic fluid under pressure is supplied to the unit from the regenerative source to cause boosting of the speed of the wagon by forced return displacement of the portion in direct or indirect engagement with a wheel of the wagon.

8 Claims, 2 Drawing Sheets

RAILWAY WAGON RETARDER

BACKGROUND OF THE INVENTION

1. Field of the Invention

This invention relates to railway wagon retarders, and in particular railway wagon retarders having the capability of retarding or boosting the speed of a wagon passing along a railway track.

2. Description of the Prior Art

One form of railway retarder/booster device is illustrated in UK Patent No. 1462045 corresponding to U.S. Patent application No. 447,004 filed Feb. 28 1974, now abandoned. In the device described in this patent the speed boosting capability of the device is achieved using a pneumatic arrangement which operates a speed booster unit separate from the usual retarder unit. The air supply provided to the device in order to facilitate the pneumatic arrangement is common to a number of devices and is not distinct to one particular device. Therefore there are a number of air supply lines to these devices distributed over the marshalling yard.

Now, in certain countries the operating conditions, i.e. the maintenance of the installed devices, land conditions, etc., are not favourable for the maximum efficiency of operation of such retarding devices. In fact a particular source of trouble has been shown to be the air supply lines which can fail in operation. Such devices need a regular maintenance program paying particular attention to the air supply lines.

The present invention is concerned with providing an alternative type of railway wagon retarder having a speed boosting capability.

SUMMARY OF THE INVENTION

According to the present invention there is provided a railway wagon retarder for installation adjacent a railway track for reducing the speed of a wagon rolling along the track and additionally having the capability of boosting the speed of a wagon rolling along the track, the retarder including a hydraulic unit having a portion adapted to be disposed in the path of a wheel of the wagon and to be deflected out of the path of the wheel when engaged by the wheel before returning to its original position, the hydraulic unit having adjustable hydraulic damping capable of resisting such deflection to retard the wagon, and a wagon speed responder for adjusting the hydraulic damping of the hydraulic unit to retard a wagon when the wagon is travelling at high speed, wherein the retarder further includes a regenerative source of hydraulic fluid under pressure connected to the hydraulic unit by valve means such that, when a wagon passes over the hydraulic unit which is travelling at high speed, the resultant retarding operation of the hydraulic unit results in charging of the regenerative source with hydraulic fluid whereas, when a wagon subsequently passes over the hydraulic unit which is travelling at low speed, hydraulic fluid under pressure is supplied to the hydraulic unit from the regenerative source to cause boosting of the speed of the wagon by forced return displacement of said portion of the hydraulic unit in engagement with a wheel of the wagon.

It will be understood that, in operation of the retarder, the head portion may be directly or indirectly engaged by the wheel of the wagon.

It is preferred that the retarder also includes a further source of hydraulic fluid for supplying hydraulic fluid to, or receiving hydraulic fluid from, the hydraulic unit to equalise the hydraulic fluid in the hydraulic unit after transfer of hydraulic fluid between the hydraulic unit and the regenerative source.

Such a retarder has the advantage over the previously proposed forms of retarder incorporating a speed boosting capability that it is a self contained unit which does not require air supply lines and which can be buried under the railway track if desired.

In a preferred embodiment of the retarder, the regenerative source of hydraulic fluid is enclosed within the source of hydraulic fluid or vice versa.

Preferably the further source of hydraulic fluid is connected to a low pressure atmosphere. In one embodiment of the invention envisaged the further hydraulic source is connected to the low pressure side of the hydraulic unit.

The hydraulic fluid in the retarder may be any one of those already known in the industry for this particular service.

The invention also includes a railway marshalling yard including a railway wagon retarder made in accordance with the present invention.

BRIEF DESCRIPTION OF THE DRAWINGS

The invention will now be illustrated with reference to the accompanying drawing, which relate to a preferred retarder in accordance with the present invention, and in which.

DETAILED DESCRIPTION OF THE DRAWINGS

Figure 1:
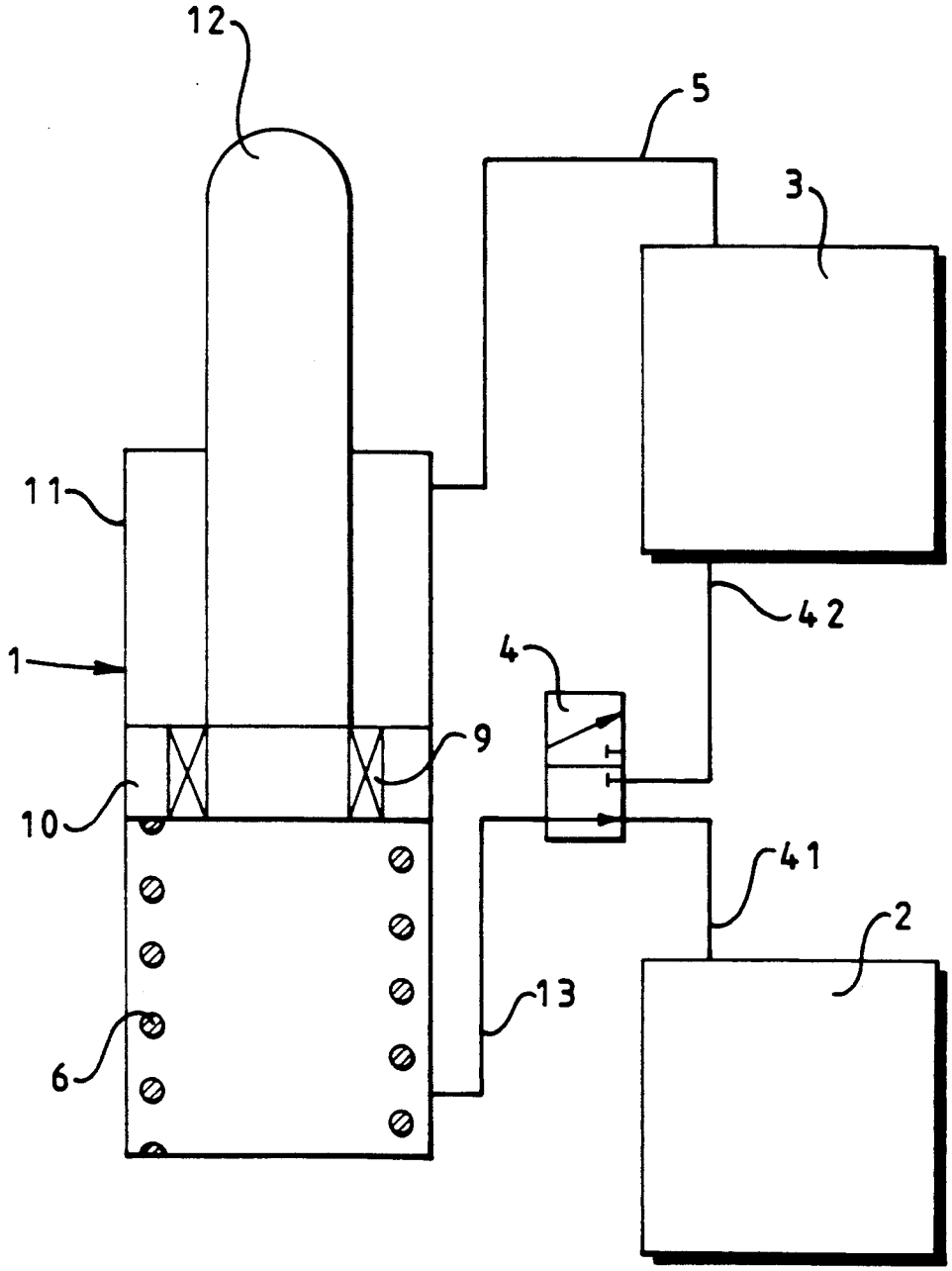
FIG. 1 is a schematic diagram showing the general principle of operation of the retarder.

Referring to FIG. 1, which shows a highly schematic diagram of the retarder provided for the purposes of general explanation of the operating principles only, the retarder comprises a hydraulic unit 1, a regenerative source 2 of hydraulic fluid under pressure, a source 3 of hydraulic fluid, a selector valve 4, a fluid by-pass line 5 connecting the source 3 to the hydraulic unit 1, and a spring 6. The function of the spring 6 may alternatively be undertaken by a nitrogen gas cushion (as shown at 43 in FIG. 3).

The hydraulic unit 1 comprises a cylinder 11 and a piston 10 which is capable of moving up and down within the cylinder 11. A flow-sensitive valve 9 extends through the piston 10 comprising a series of holes capable of being closed off by a sprung plate when the piston is displaced at high speed, as well as a high pressure relief valve (not shown in FIG. 1).

Figure 2:
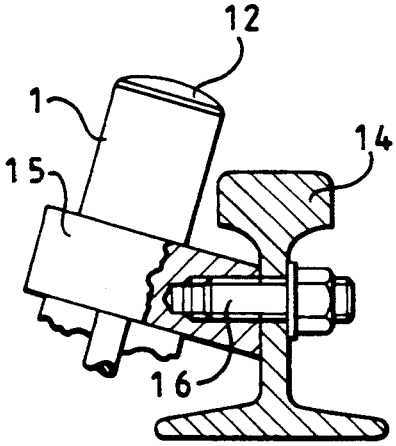
FIG. 2 is a view of the retarder, partly in section, attached to a rail.

Furthermore, as shown in FIG. 2, the hydraulic unit 1 is mounted on a single rail 14 of a railway track by a bracket 15 and a bolt 16 so that a head portion 12 of the unit is disposed in the path of a wheel of a wagon rolling along the track to be deflected downwardly by direct of indirect engagement by the wheel. As in prior arrangements, on passage of a railway wagon over the retarder, a wheel of the wagon engages the head portion 12 of the hydraulic unit 11 forcing the piston 10 down within the cylinder 11 (downstroke). Once past the apex of the wheel's motion relative to the retarder the piston 10 travels up within the cylinder 11 (upstroke) whilst maintaining contact with the wheel of the railway wagon.

However, as shown in FIG. 1, a hydraulic line connects the cylinder 11 below the piston 10 to the selector valve 4. The selector valve 4 is also connected to the regenerative source 2 of hydraulic fluid under pressure by a line 41 and to the source 3 of hydraulic fluid by a line 42. The lines 41 and 42 are independent of one another. Furthermore the by-pass line 5 is connected to the cylinder 11 on the low pressure side of the piston 10 so that no substantial pressure fluid up occurs in the source 3 of hydraulic fluid.

The regenerative source 2 of hydraulic fluid under pressure is in the form of a hydraulic accumulator containing an amount of nitrogen under pressure in addition to the hydraulic fluid therein. The nitrogen maintains the hydraulic fluid in the regenerative source 2 under pressure, and, in the event of no hydraulic fluid being present in the regenerative source 2, the nitrogen maintains the pressure in the source providing the necessary retardation forces.

In operation in the retarding mode which is operational when the wagon passing over the retarder is travelling at high speed, on the downstroke of the piston 10, the flow-sensitive valve 9 is closed and the cylinder 11 is connected to the regenerative source 2 of hydraulic fluid by the selector valve 4 in response to high speed displacement of the piston 10. Therefore, as the piston 10 is moved downwardly, hydraulic fluid from the hydraulic unit 1 is forced into the regenerative source 2. Once the piston 10 has passed the apex of the downstroke and entered the upstroke under the action of the spring 6, the cylinder 11 is connected by the selector valve 4 to the hydraulic source 3. Therefore, as the piston 10 moves upwards, hydraulic fluid is drawn from the source 3, which is at a lower pressure than the regenerative source 2, into the cylinder 11 so replenishing the hydraulic fluid therein.

On the other hand, in operation in the boosting mode which is operational when the wagon passing over the retarder is travelling at low speed, on the downstroke of the piston 10, the flow-sensitive valve 9 is not closed and the cylinder 11 is connected to the hydraulic source 3 by the selector valve 4 due to the low speed displacement of the piston 10. Therefore, as the piston 10 is moved downwardly, the hydraulic fluid from the hydraulic unit 1 is forced into the hydraulic source 3, and a relatively minor retarding force relative to that in the retardation mode on downstroke is induced. Once the piston has passed the apex of its travel and begins the upstroke, the hydraulic unit 1 is connected to the regenerative source 2 by the selector valve 4, thus forcing hydraulic fluid from the source 2 into the cylinder 11 below the piston 10 and imparting a boosting force to the wagon wheel by forced upward displacement of the portion 12 is engagement with the wheel.

In this arrangement, during retardation operation, hydraulic fluid is forced into the regenerative source of hydraulic fluid, thus in effect replenishing the hydraulic fluid under pressure necessary to effect boosting of the slower wagons passing over the retarder. In view of this, in order to maintain the retarder fully operational over an extended period, the retarder is preferably designed to fulfill the exact criteria of the job in hand dependent upon the actual working/operating conditions. As the regenerative source of fluid under pressure can only store a certain amount of fluid under pressure, and needs the retardation of wagons to replenish this fluid source, it is important for maintained operational efficiency that the device has an effectively equal number of retardations and boostings. Otherwise, the boosting capability will be random in operational effect. Therefore, the retarder should be designed to bring this about. In some cases, in order to ensure continued operational efficiency, it may be appropriate for a plurality of retarders, for example four retarders, to be connected to a common regenerative source of fluid under pressure.

Preferably the retarder is provided with means which allow adjustment of the speed at which the operational mode, either retardation or boosting, is selected.

A more detailed description will now be given of a preferred form of hydraulic unit 1 with reference to FIG. 3, it being understood that the unit 1 has only been described above in simplified form sufficient to permit a broad understanding to be obtained of the general principles of operation.

Figure 3:
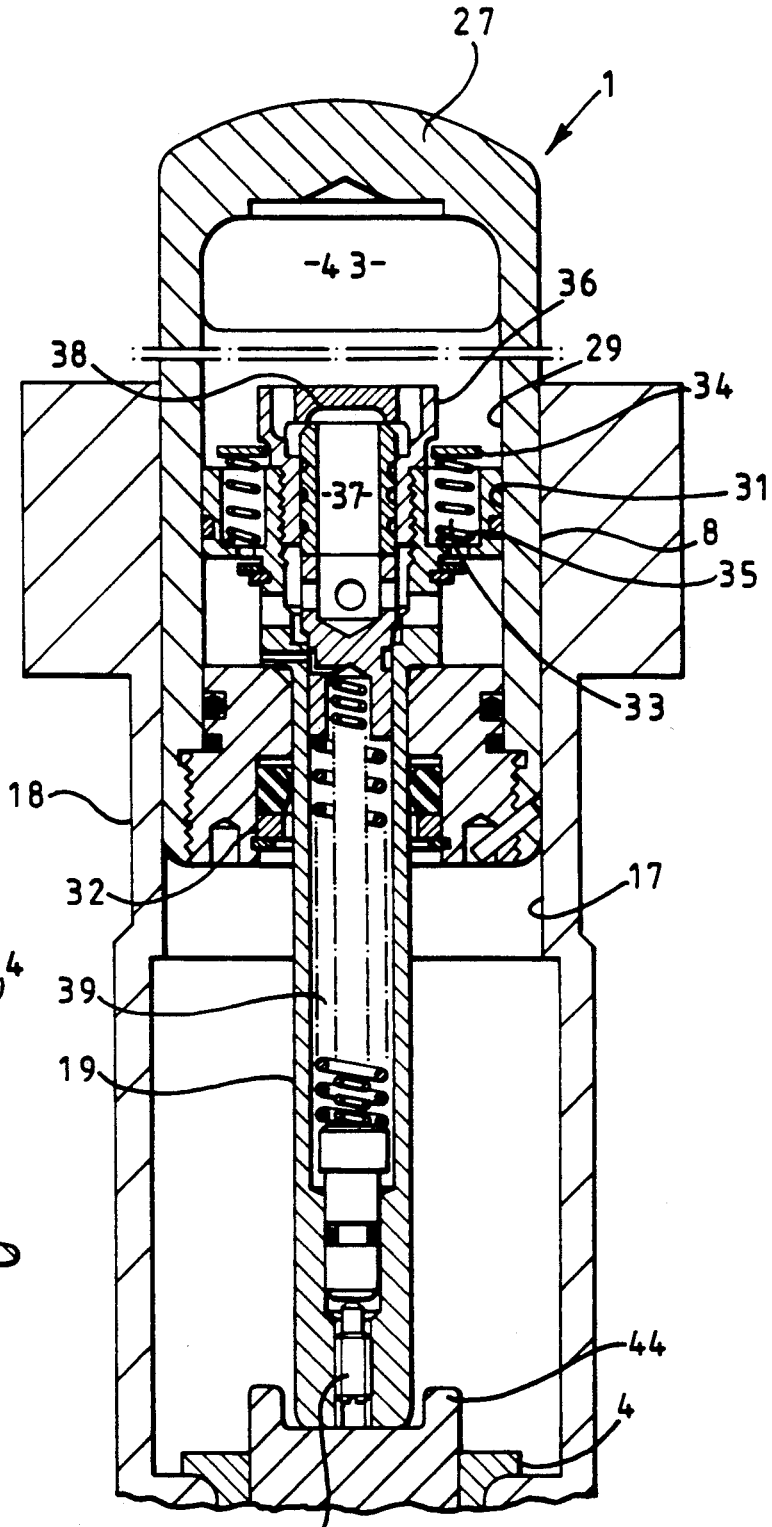
FIG. 3 is a section through a preferred form of hydraulic unit of the retarder.

Referring to FIG. 3, the hydraulic unit 1 comprises a hollow cylinder 8 having a rounded upper end 27 for engagement with the flange of a wheel on the railway rail. The cylinder 8 is a drop-in fit within a bore 17 of a guide receptacle 18 and a hollow rod 19 projects downwardly from the cylinder 8. The cylinder 8 has a bore 29, and a piston 31 carried at the inner end of the rod 19 is reciprocable within the bore 29. The rod 19 in its passage through the lower end of cylinder 8 passes through a seal 32. The seal 32 is the sole hydraulic seal associated with the unit 1 and has the function of preventing escape of hydraulic fluid from the bore 29 to the atmosphere.

A plurality of holes 33 extend through the piston 31, and around the upper side of the piston a ring 34 is provided which is held at a spaced position from the upper side of the piston by means of springs 35 within the holes 33 to form a flow-sensitive valve. The ring 34 at its outermost position engages an enlargement 36 extending from the upper side of the piston 31. Within the centre of the piston 31 a high pressure relief valve is provided which takes the form of a sleeve 37 engaging a seat 38 to shut off the flow from one side of the piston to the other. The sleeve 37 is urged on to its seat by means of a compression spring 39 housed within the rod 19. The compression in spring 39 is adjustable in a preset manner by a screwthread device 22 accessible at the lower end of the rod 19. The bore 29 is partially filled with hydraulic fluid up to a predetermined level, and a compressed gas cushion 43 such as nitrogen is located above the fluid. The function of the compressed gas cushion 43 is to enable the rod 19 to be urged inwardly into the bore 29 against elastic compression of the gas, the gas then providing a constantly acting force to urge the rod 19 outwardly. The volume of the gas cushion 43 is sufficient to accommodate full entry of the rod 19 into the bore 29 to a position where the upper side of the piston 31 contacts the upper end of the bore 29.

The ring 34 and the springs 35 provide speedsensitive damping in that, when the rod 19 is urged into the bore 29, the displacement of hydraulic fluid from the upper side to the lower side of the piston 31 must pass through the gap between the ring 34 and the upper side of the piston 31. If the flow rate of hydraulic fluid is sufficient (as occurs in the retarding mode), the ring 34 will be moved down to engage the upper side of the piston 31 to close the holes 33. When this happens the sole escape for hydraulic fluid from one side of the piston to the other is through the relief valve sleeve 37. Hydraulic fluid on the upper side of the piston 31 will react on the annular cross-section of the sleeve 37 to provide an endwise force acting against the spring 39, and, when the pressure rises sufficiently, the valve will open allowing passage of hydraulic fluid from above to below the piston. Thus it will be seen that, at or above a predetermined speed of entry of the rod 19 into the bore 29, the ring 34 will be urged onto the upper surface of the piston 31 to close the holes 33. For speeds lower than the predetermined speed the springs 35 will hold the ring 34 in its uppermost position. For speeds below the predetermined speed the flow of hydraulic fluid from side to side of the piston 31 is comparatively unrestricted, and the force required to move the rod 19 into the bore 29 is only that necessary to provide compression of the gas cushion 43. For a speed of rod entry above the predetermined speed the ring 34 will close the holes 31 and displacement of hydraulic fluid can then only occur when its pressure can open the relief valve. Therefore entry of the rod 19 into the bore 29 at speeds above the predetermined speed will require considerable effort and the required retarding effect will be achieved.

The hydraulic unit 1 is retained in the bore 17 of the guide receptacle 18 by gravity, the rod 19 resting on a plunger 44 of the selector valve 4 to effect displacement of the plunger 44 against the action of a compression spring (not shown) so that, on the downstroke of the cylinders in the retarding mode, the selector valve 4 is positioned to supply hydraulic fluid from above the piston 31 of the hydraulic unit 1 to the regenerative source 2 by way of the line 41, whereas, on the downstroke of the cylinder 8 in the boosting mode, the lesser force exerted by the rod 19 on the plunger 44 will result in the selector valve 4 being positioned to supply hydraulic fluid from above the piston 31 to the source 3 by way of the line 42. Furthermore, on the upstroke of the cylinder 8 in the retarding mode, the selector valve 4 is positioned to introduce hydraulic fluid above the piston 31 from the source 3 by way of the line 42, and, on the upstroke of the cylinder 8 in the boosting mode, the selector valve 4 is positioned to permit hydraulic fluid under pressure from the regenerative source 2 to be forced into the space above the piston 31 to provide the required boosting force.

I claim:

1. A railway wagon retarder for installation adjacent a railway track for reducing speed of a wagon rolling along the track and additionally having the capability of boosting the speed of a wagon rolling along the track, the retarder including a hydraulic unit having a head portion adapted to be disposed in a path of a wheel of the wagon and to be deflected out of the path of the wheel when engaged by the wheel before returning to its original position, the hydraulic unit having speed dependent hydraulic damping resisting such deflection so as to significantly retard the wagon when the wagon is travelling at relatively high speed but to insignificantly retard the wagon when the wagon is travelling at relatively low speed, a regenerative source of hydraulic fluid under pressure, and valve means connected between the hydraulic unit and the regenerative source and operative to effect charging of the regenerative source with hydraulic fluid in response to retarding operation of the hydraulic unit when a wagon passes over the hydraulic unit which is travelling at high speed, and to effect supply of hydraulic fluid under pressure to the hydraulic unit from the regenerative source when a wagon subsequently passes over the hydraulic unit which is travelling at low speed to cause boosting of the speed of the wagon by forced return displacement of said head portion of the hydraulic unit in engagement with a wheel of the wagon substantially all pressure regenerated to said regenerative source being derived directly from said retarding operation of the hydraulic unit.

2. A railway wagon retarder according to claim 1, wherein the regenerative source of hydraulic fluid under pressure is a hydraulic accumulator incorporating gas under high pressure.

3. A railway wagon retarder according to claim 1, wherein the hydraulic unit comprises a piston and cylinder, said head piston of the hydraulic unit is coupled to the cylinder, and the regenerative source is connected to the cylinder by a hydraulic line incorporating the valve means for transfer of hydraulic fluid between the regenerative source and the cylinder.

4. A railway marshalling yard incorporating a railway wagon retarder according claim 1.

5. A railway wagon retarder according to claim 1, wherein the hydraulic unit comprises a piston and cylinder, and a flow-sensitive valve extends through the piston to effect said speed-dependent hydraulic damping.

6. A railway wagon retarder according to claim 1, wherein the hydraulic unit comprises a piston and cylinder, and a high pressure relief valve extends through the piston.

7. A railway wagon retarder according to claim 6, wherein the high pressure relief valve is adjustable to vary its actuation pressure.

8. A railway wagon retarder according to claim 1, wherein it includes a further source of hydraulic fluid coupled to the hydraulic unit for supplying hydraulic fluid to, or receiving hydraulic fluid from, the hydraulic unit to equalize the hydraulic fluid in the hydraulic unit after transfer of hydraulic fluid between the hydraulic unit and the regenerative source.

* * * * *